US010232213B1

(12) United States Patent
Smith, Jr.

(10) Patent No.: US 10,232,213 B1
(45) Date of Patent: Mar. 19, 2019

(54) MULTI-PURPOSE EXERCISE BENCH

(71) Applicant: Alfred Sidney Smith, Jr., Sammamish, WA (US)

(72) Inventor: Alfred Sidney Smith, Jr., Sammamish, WA (US)

( * ) Notice: Subject to any disclaimer, the term of this patent is extended or adjusted under 35 U.S.C. 154(b) by 220 days.

(21) Appl. No.: 15/370,347

(22) Filed: Dec. 6, 2016

(51) Int. Cl.
*A63B 21/00* (2006.01)
*A63B 21/04* (2006.01)
(Continued)

(52) U.S. Cl.
CPC ..... *A63B 21/0552* (2013.01); *A63B 21/0442* (2013.01); *A63B 21/4035* (2015.10);
(Continued)

(58) Field of Classification Search
CPC ..... A63B 1/00; A63B 3/00; A63B 21/00058; A63B 21/00061; A63B 21/00065; A63B 21/0069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0422; A63B 21/055; A63B 21/0552; A63B 21/0555; A63B 21/0557; A63B 21/4025; A63B 21/4027; A63B 21/4029; A63B 21/4033; A63B 21/4034; A63B 21/4035; A63B 21/4043; A63B 21/4047; A63B 22/0046; A63B 23/02; A63B 23/0205; A63B 23/0211; A63B 23/0216; A63B 23/0222; A63B 23/035; A63B 23/03508; A63B 23/03516; A63B 23/03533; A63B 23/03541; A63B 23/0355; A63B 23/03575; A63B 23/04; A63B 23/0405; A63B 23/0482; A63B 23/0494; A63B 23/12; A63B 23/1209; A63B 23/1245; A63B 23/1281; A63B 2023/0411; A63B 69/0057; A63B 69/0059; A63B 2069/0062; A63B 2208/0204; A63B 2208/0209; A63B 2208/0228; A63B 2208/0238; A63B 2210/00; A63B 2210/50; A63B 2225/09;
(Continued)

(56) References Cited

U.S. PATENT DOCUMENTS 2,362,111 A * 11/1944 Burns ..... A63B 23/0211 482/140
2,714,507 A * 8/1955 Goodrich ..... A63B 22/0076 482/72

(Continued)

*Primary Examiner* — Gary D Urbiel Goldner
(74) *Attorney, Agent, or Firm* — Quickpatents, LLC; Kevin Prince

(57) ABSTRACT

An exercise bench comprises a pair of perforated side frames, each including a rear member projecting upward from a rear side of a base member, and an angled member fixed at an angle between the rear and base members. The pair of side frames are mutually aligned and fixed together at perforated forward and unperforated top cross members. A seat fixed between the pair of side frames at the angled members and attached thereto with pivot mechanisms is moveable along the side frames. The rear, base, and angled members are moveable relative to each other and fixable to at least one resistant band anchor.

14 Claims, 7 Drawing Sheets

(51) Int. Cl.

| | |
|---|---|
| ***A63B 23/02*** | (2006.01) |
| ***A63B 23/04*** | (2006.01) |
| ***A63B 23/12*** | (2006.01) |
| ***A63B 21/055*** | (2006.01) |
| ***A63B 23/035*** | (2006.01) |

(52) U.S. Cl.
CPC .... *A63B 23/0211* (2013.01); *A63B 23/03575* (2013.01); *A63B 23/0405* (2013.01); *A63B 23/1281* (2013.01); *A63B 2208/0204* (2013.01); *A63B 2208/0209* (2013.01); *A63B 2208/0238* (2013.01); *A63B 2210/50* (2013.01)

(58) Field of Classification Search
CPC ..... A63B 2225/093; A63B 2225/10; A63B 2225/102
USPC ..... 482/907
See application file for complete search history.

(56) References Cited

U.S. PATENT DOCUMENTS

| | | | | | |
|---|---|---|---|---|---|
| 3,709,487 | A | | 1/1973 | Walker | |
| 4,195,834 | A | * | 4/1980 | Lambert, Jr. | A63B 21/06 482/101 |
| 4,200,279 | A | * | 4/1980 | Lambert, Jr. | A63B 21/06 482/100 |
| 4,369,969 | A | * | 1/1983 | Straub | A63B 23/03575 482/142 |
| 4,623,144 | A | * | 11/1986 | Rockwell | A63B 23/0233 482/100 |
| 4,638,995 | A | * | 1/1987 | Wilson | A63B 21/0004 297/452.13 |
| 4,826,158 | A | * | 5/1989 | Fields, Jr. | A63B 23/0488 482/142 |
| 5,306,220 | A | * | 4/1994 | Kearney | A63B 23/00 482/104 |
| 5,320,591 | A | | 6/1994 | Harmon | |
| 5,704,856 | A | | 1/1998 | Morse | |
| 6,238,324 | B1 | | 5/2001 | MacMillan | |
| 7,025,415 | B1 | * | 4/2006 | Wu | A47C 9/002 297/119 |
| 7,137,937 | B2 | | 11/2006 | Croft | |
| 7,611,450 | B2 | | 11/2009 | Mancini | |
| 7,946,970 | B2 | | 5/2011 | Garza | |
| 8,043,199 | B1 | * | 10/2011 | Barker | A63B 22/0023 482/132 |
| 8,062,195 | B2 | | 11/2011 | Israeli | |
| 8,303,473 | B2 | | 11/2012 | Gutierrez | |
| D816,785 | S | * | 5/2018 | Smith, Jr. | D21/694 |
| D819,148 | S | * | 5/2018 | Smith, Jr. | D21/690 |
| 2004/0058788 | A1 | * | 3/2004 | Thompson | A63B 21/068 482/95 |
| 2004/0157712 | A1 | * | 8/2004 | Bodily | A61H 1/0266 482/142 |
| 2005/0130814 | A1 | | 6/2005 | Nitta | |
| 2006/0040810 | A1 | * | 2/2006 | Chu | A63B 21/068 482/142 |
| 2007/0184949 | A1 | * | 8/2007 | Weir | A63B 21/055 482/130 |
| 2011/0092348 | A1 | | 4/2011 | McBride | |
| 2013/0225378 | A1 | * | 8/2013 | Burek | A63B 26/00 482/142 |
| 2014/0024508 | A1 | | 1/2014 | Hinds | |
| 2016/0236027 | A1 | * | 8/2016 | Bastyr | A63B 21/068 |

* cited by examiner

MULTI-PURPOSE EXERCISE BENCH

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to fitness equipment, and more particularly to an exercise bench adapted to be: relatively compact; collapsible for easy storage and movement; portable; highly adjustable for extreme versatility in performing various exercises suitable to work out every part of the body; and equipped for the easy storage, attachment, and use of a variety of customizable resistance band- and barbell-based exercise equipment.

BACKGROUND

This invention relates to fitness equipment, and more particularly to an exercise bench adapted to be: relatively compact; collapsible for easy storage and movement; portable; highly adjustable for extreme versatility in performing various exercises suitable to work out every part of the body; and equipped for the easy storage, attachment, and use of a variety of customizable resistance band- and barbell-based exercise equipment. The prior art includes: U.S. Pat. No. 7,137,937 (Nov. 21, 2006); U.S. Patent Application No. 20050130814 (Jun. 6, 2005); U.S. Patent Application No. 20110092348 (Apr. 21, 2011); U.S. Pat. No. 5,320,591 (Jun. 14, 1994); U.S. Pat. No. 8,062,195 (Nov. 22, 2011); U.S. Pat. No. 3,709,487 (Jan. 9, 1973); U.S. Pat. No. 7,611,450 (Nov. 3, 2009); U.S. Pat. No. 8,303,473 (Nov. 6, 2012); U.S. Patent Application No. 20140024508 (Jan. 23, 2014); U.S. Pat. No. 6,238,324 (May 29, 2001); U.S. Pat. No. 7,946,970 (May 24, 2011); and U.S. Pat. No. 5,704,856 (Jan. 6, 1998). It is desirable to have an improved exercise bench that is superior to any that is disclosed or suggested in the identified references.

SUMMARY OF THE INVENTION

The present device is an exercise bench for use in an assembled configuration by a person on a support surface. The exercise bench comprises a pair of side frames, each including: a base member, a rear member projecting upward from a rear side of the base member, and an angled member fixed at an angle between the base member and the rear member. Each side frame is aligned with the other and mutually fixed together at a forward cross member and a top cross member. In the preferred embodiment of the exercise bench, each base member, rear member, and angled member of the side frames, and the forward cross member, is formed with a perforated square metal tube material having a plurality of longitudinally-aligned equally-spaced apertures formed along each side thereof.

The exercise bench further comprises a seat fixed between each side frame at the angled members and attached thereto with a pair of pivot mechanisms. The seat includes a resilient cushion fixed between the pivot mechanisms. When the exercise bench is in use with the base members resting on the support surface, the person can adjust the angle of the seat to support his weight while performing exercises.

Each pivot mechanism includes a first aperture engagement mechanism, whereby the position of the seat may be adjusted along any of the base members, rear members, and angled members of the side frames, as well as a second aperture engagement mechanism, whereby the position of each of the base members, rear members, and angled members of the side frames may be adjusted along any of the other base members, rear members, and angled members of the side frames.

The preferred embodiment further includes at least one resistance band anchor fixable through any opposing apertures of the base members, the rear members, the angled members, or the forward cross member. The resistance band anchor is also fixable with the top cross member. The resistance band anchor includes a rigid ring through which a distal end of a resistance band may be fixed.

The preferred embodiment also includes a footrest fixed between each side frame at the base members and attached thereto with a pair of the pivot mechanisms. The footrest may additionally include a foot plate having two foot straps projecting outwardly therefrom, whereby the person can place his feet on the foot plate through the foot straps to hold his feet to the footrest while exercising. The preferred embodiment further includes a pair of barbell supports each fixed with one of the pivot mechanisms to one of the side frame base members, rear members, or angled members, whereby a barbell is supported on the barbell supports while the person exercises. Each one of the barbell supports is ideally formed with the perforated square metal tube material, having a plurality of longitudinally-aligned equally-spaced apertures formed along each side thereof. Preferably, a durable cover is fitted over a distal end of each barbell support, with a pair of apertures formed through each cover and aligned with two of the apertures of the metal tube material. This enables a barbell stop to be fixed therethrough to support the barbell and prevent the barbell from rolling.

The preferred embodiment features at least one resistance band anchor and at least one resistance band, and includes the barbell having two opposing resistance band attachment rings fixed therewith, such that one of the resistance bands may be fixed at a proximal end thereof to the barbell and at the distal end thereof to the resistance band anchor. This enables the person to lift the barbell to stretch the resistance bands. In this configuration, when the resistance band is fixed at the proximal end to a foot loop and at the distal end to one of the resistance band anchors, the person can engage the foot loop with his foot and stretch the resistance band.

The preferred embodiment of the resistance band is comprised of the resistance band anchor (fixable through any opposing apertures of the base members, the rear members, the angled members, and the forward cross member, as well as fixable to the top cross member), an elastic portion, a non-elastic portion, and a user interface portion. The elastic portion and the user interface portion are each selectively interchangeable for changing the elastic resistance of the resistance band and for allowing engagement of the resistance band with a different part of the body of the person. Optionally, the resistance band anchor and the non-elastic portion are engageable with the elastic portion at a pair of buckle mechanisms, and the user interface portion is engageable with the non-elastic portion at a third buckle mechanism.

When not in use, the exercise bench may be configured into a collapsed configuration, enabling the easy movement or storage of the exercise bench. When the exercise bench is in the collapsed configuration, it may be secured in place using a rope. When the exercise bench is in the assembled configuration, the rope may be stored by wrapping it around the top cross member. The rope may also be used together with the exercise bench by the person to perform specific types of exercises.

The present exercise bench is a multi-purpose exercise bench designed for both home and commercial use. It has a small footprint in its assembled configuration; is portable and easy to move in its collapsed configuration; includes a fully integrated platform for the use and storage of resistance band- and barbell-based exercise equipment; and is highly adjustable through a combination of moving specific detachable parts into selected positions, and incorporating resistance bands, free weights, or the user's own body weight to achieve a desired resistance for maximum training. This extremely versatile exercise bench facilitates positioning its various components in the optimal arrangement to perform over 100 unique exercises. This versatile nature enables the user to practice an effective full-body exercise program with a single piece of workout equipment. As a fully integrated fitness platform, it also streamlines the exercise process and enables the user to conduct a complete program of exercise much faster than would be possible with multiple pieces of equipment that each required numerous adjustments to use.

Further, the exercise bench's compact and portable collapsed configuration allows it to be stored easily in space-restricted buildings, and easily moved around within a building or even to a new building. It also saves noncommercial users who are able to self-direct their own fitness programs great amounts of time and money by eliminating the need for a fitness services provider, and its collapsed configuration prevents unsightly displays and potential falling and tripping hazards by allowing the entire exercise bench to be easily stored away when not in use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
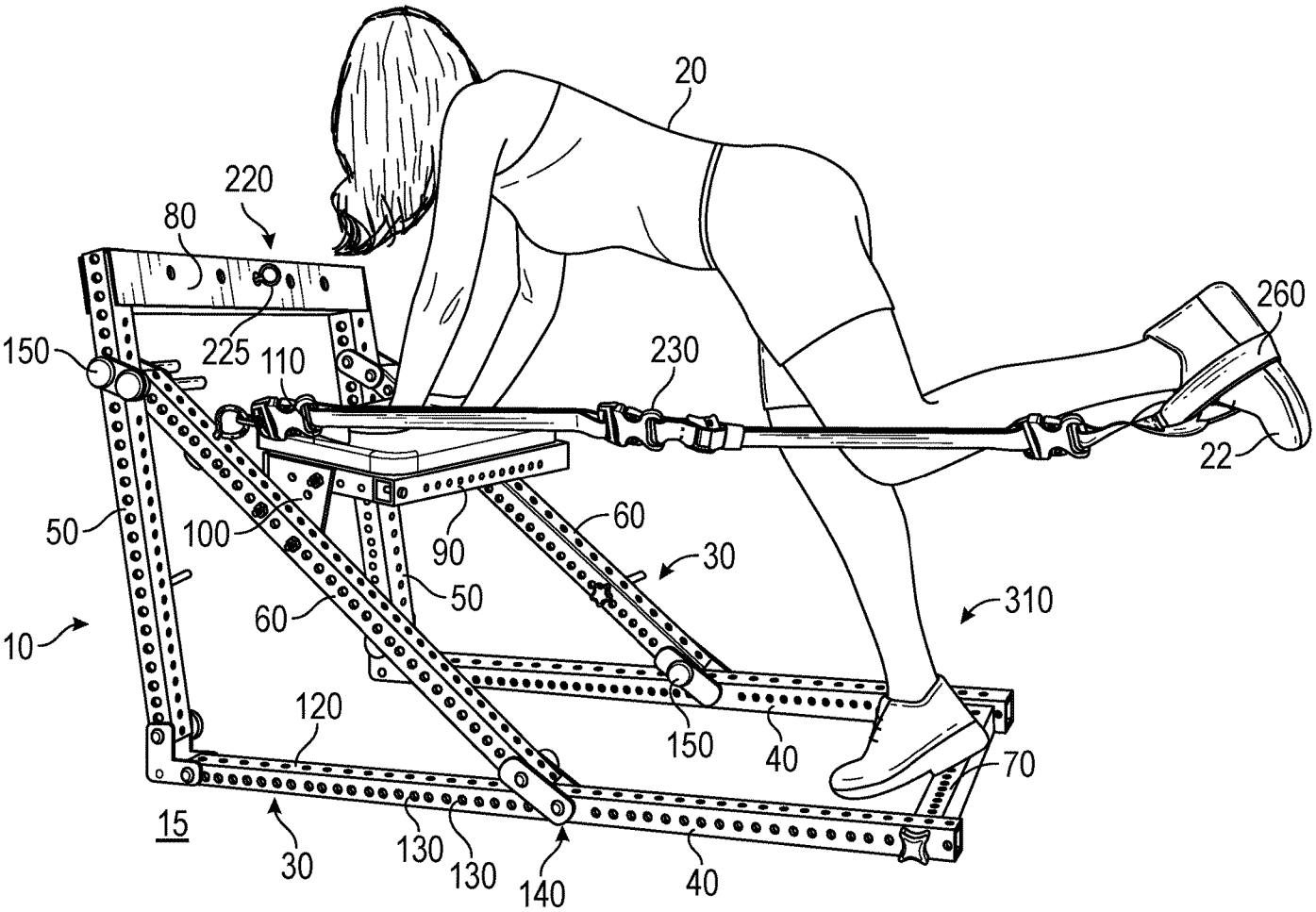
FIG. 1 is a side perspective view of one embodiment of the invention, shown in use by a person bracing her arms against the seat while using the resistance band to conduct a leg exercise.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. Finally, "Detailed Description" refers to this Detailed Description of the Preferred Embodiment.

FIGS. 1-6 illustrate an exercise bench 10 for use in an assembled configuration 310 (FIG. 1) by a person 20 on a support surface 15 (such as a floor). The exercise bench 10 comprises a pair of side frames 30, each including: a base member 40, a rear member 50 projecting upward from a rear side 48 of the base member 40, and an angled member 60 fixed at an angle between the base member 40 and the rear member 50. Each side frame 30 is aligned with the other and mutually fixed together at a forward cross member 70 and a top cross member 80. In every preferred embodiment of the exercise bench 10, each base member 40, rear member 50, and angled member 60 of the side frames 30, and the forward cross member 70, is formed with a perforated square metal tube material 120 (FIG. 1) having a plurality of longitudinally-aligned equally-spaced apertures 130 (FIG. 1) formed along each side thereof. The perforated square metal tube material 120 may be manufactured from any material otherwise suitable for the construction of exercise equipment intended for long-term use, including but not limited to: steel; aircraft-strength aluminum; iron; and the like. Further, the perforated square metal tube material 120 may be customized to provide any number of aesthetic effects, such as by painting or coating the perforated square metal tube material 120 in various colors or patterns. In embodiments where the perforated square metal tube material 120 is aircraft-strength aluminum, the aluminum may be anodized to provide anti-corrosion protection, wear resistance, and additional decorative options, given anodized aluminum's favorability to being dyed in visually exciting ways. Whatever the perforated square metal tube material 120 is made of, any number of anti-corrosion, wear-resistant, and other protective coatings, in any combination, may be applied to increase durability and extend the service lifetime of the exercise bench 10, such as polytetrafluorethylene (sold under the brand-name Teflon®) and other commercially-available coatings with similar protective properties.

The exercise bench 10 further comprises a seat 90 (FIGS. 1, 5-6) fixed between each side frame 30 at the angled members 60 and attached thereto with a pair of pivot mechanisms 100 (FIGS. 1, 3, 5, 6). The seat 90 includes a resilient cushion 110 (FIGS. 1, 3, 5, 6) fixed between the pivot mechanisms 100. When the exercise bench 10 is in use with the base members 40 resting on the support surface 15, the person 20 can adjust the angle of the seat 90 to support his weight while performing exercises. Further, the exercise bench 10 may be configured such that the seat 90 is positioned above the top cross member 80 to create a "Roman Chair" configuration (not shown).

Each pivot mechanism 100 includes a first aperture engagement mechanism 140 (FIG. 1), whereby the position of the seat 90 may be adjusted along any of the base members 40, rear members 50, and angled members 60 of the side frames 30. In another preferred embodiment, each base member 40, rear member 50, and angled member 60 of each side frame 30 also includes a second aperture engagement mechanism 150 (FIGS. 1, 3), whereby the position of each of the base members 40, rear members 50, and angled members 60 of the side frames 30 may be adjusted along any of the other base members 40, rear members 50, and angled members 60 of the side frames 30. Optionally, the exercise bench 10 may further include at least four high-friction footpads 270 (FIG. 3) each fixed with one of the apertures 130 of the base members 40, whereby the exercise bench 10 is supported on the support surface 15 by the footpads 270. The four high-friction footpads 270 may be made from rubber or any other mechanically similar material.

The angled members 60 and the base members 40 are optionally extensible. One preferred embodiment includes a pair of angled member extensions 280 (FIG. 5), each made with the perforated square metal tube material 120 having the plurality of longitudinally-aligned equally-spaced apertures 130 formed along each side thereof, each telescopingly attachable with one of the angled members 60. Similarly, another preferred embodiment includes a pair of base member extensions 290 (FIG. 6) each made with the perforated square metal tube material 120 having the plurality of longitudinally-aligned equally-spaced apertures 130 formed along each side thereof, each telescopingly attachable with one of the base members 40.

An additional preferred embodiment further includes at least one resistance band anchor 220 (FIGS. 2, 4, 7) fixable through any opposing apertures 130 of the base members 40, the rear members 50, the angled members 60, or the forward cross member 70. In this embodiment, the resistance band anchor 220 is also fixable with the top cross member 80. The resistance band anchor 220 includes a rigid ring 225 (FIG. 2) through which a distal end 238 (FIGS. 2, 4) of a resistance band 230 (FIGS. 1, 2, 4, 6-7) may be fixed.

Another preferred embodiment also includes a footrest 160 (FIGS. 2, 5-6) fixed between each side frame 30 at the base members 40 and attached thereto with a pair of the pivot mechanisms 100. The footrest 160 may additionally include a foot plate 165 (FIGS. 2-3) having two foot straps 170 (FIGS. 3, 5) projecting outwardly therefrom, whereby the person 20 can place his feet 22 (FIGS. 1, 5) on the foot plate 165 through the foot straps 170 to hold his feet 22 to the footrest 160 while exercising.

Another preferred embodiment further includes a pair of barbell supports 180 (FIG. 2) each fixed with one of the pivot mechanisms 100 to one of the side frame 30 base members 40, rear members 50, or angled members 60, whereby a barbell 190 (FIGS. 2, 4, 6) is supported on the barbell supports 180 while the person 20 exercises. Each one of the barbell supports 180 is ideally formed with the perforated square metal tube material 120, having a plurality of longitudinally-aligned equally-spaced apertures 130 formed along each side thereof. Preferably, a durable cover 200 (FIG. 2) is fitted over a distal end 185 of each barbell support 180, with a pair of apertures 205 formed through each cover 200 and aligned with two of the apertures 130 of the metal tube material 120. This enables a barbell stop 210 (FIG. 2) to be fixed therethrough to support the barbell 190 and prevent the barbell 190 from rolling.

Any embodiment featuring at least one resistance band anchor 220 and at least one resistance band 230 may preferably include the barbell 190 having two opposing resistance band attachment rings 240 (FIGS. 2, 6) fixed therewith, such that one of the resistance bands 230 may be fixed at a proximal end 232 thereof to the barbell 190 and at the distal end 238 thereof to the resistance band anchor 220. This enables the person 20 to lift the barbell 190 to stretch the resistance bands 230. Optionally, a padded cushion 250 (FIGS. 2, 4, 6) is fixed around the barbell 190, between the two opposing resistance band attachment rings 240, significantly increasing grip comfort (and thus grip stability and safety) for the person 20 while the barbell 190 is in use. Such embodiments may also include the resistance band 230 fixed at the proximal end 232 to a foot loop 260 (FIG. 1) and at the distal end 238 to one of the resistance band anchors 220, whereby the person 20 can engage the foot loop 260 with his foot 22 and stretch the resistance band 230.

Figure 7:
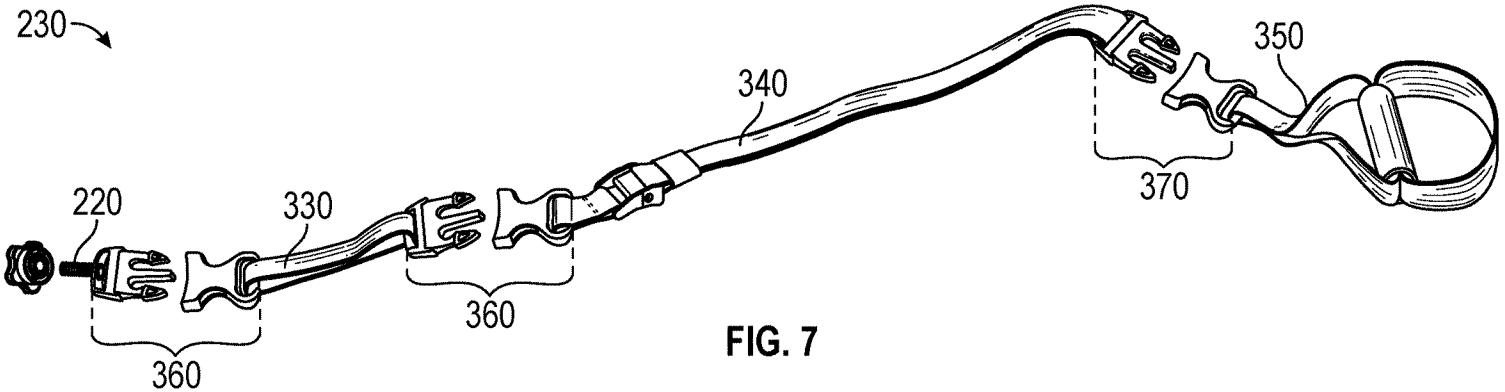
FIG. 7 is a top perspective exploded view of the resistance bands.
Figure 8:
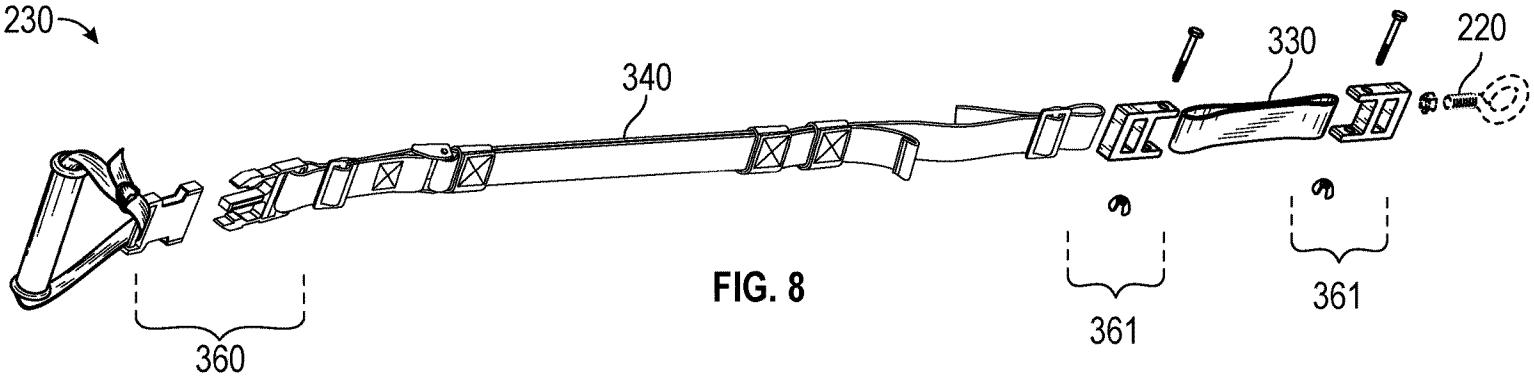

One preferred embodiment of the resistance band 230 is comprised of the resistance band anchor 220 (fixable through any opposing apertures of the base members 40, the rear members 50, the angled members 60, and the forward cross member 70, as well as fixable to the top cross member 80), an elastic portion 330 (FIGS. 7 and 8), a non-elastic portion 340, and a user interface portion 350. The elastic portion 330 and the user interface portion 350 are each selectively interchangeable for changing the elastic resistance of the resistance band 230 and for allowing engagement of the resistance band 230 with a different part of the body of the person 20. Optionally, the resistance band anchor 220 and the non-elastic portion 340 are engageable with the elastic portion 330 at a pair of buckle mechanisms 360 (FIG. 7), and the user interface portion 350 is engageable with the non-elastic portion 340 at a third buckle mechanism 370 (FIG. 7). An alternate preferred view of the resistance band 230 having an alternate buckle mechanism 361 is shown in FIG. 8.

Figure 2:
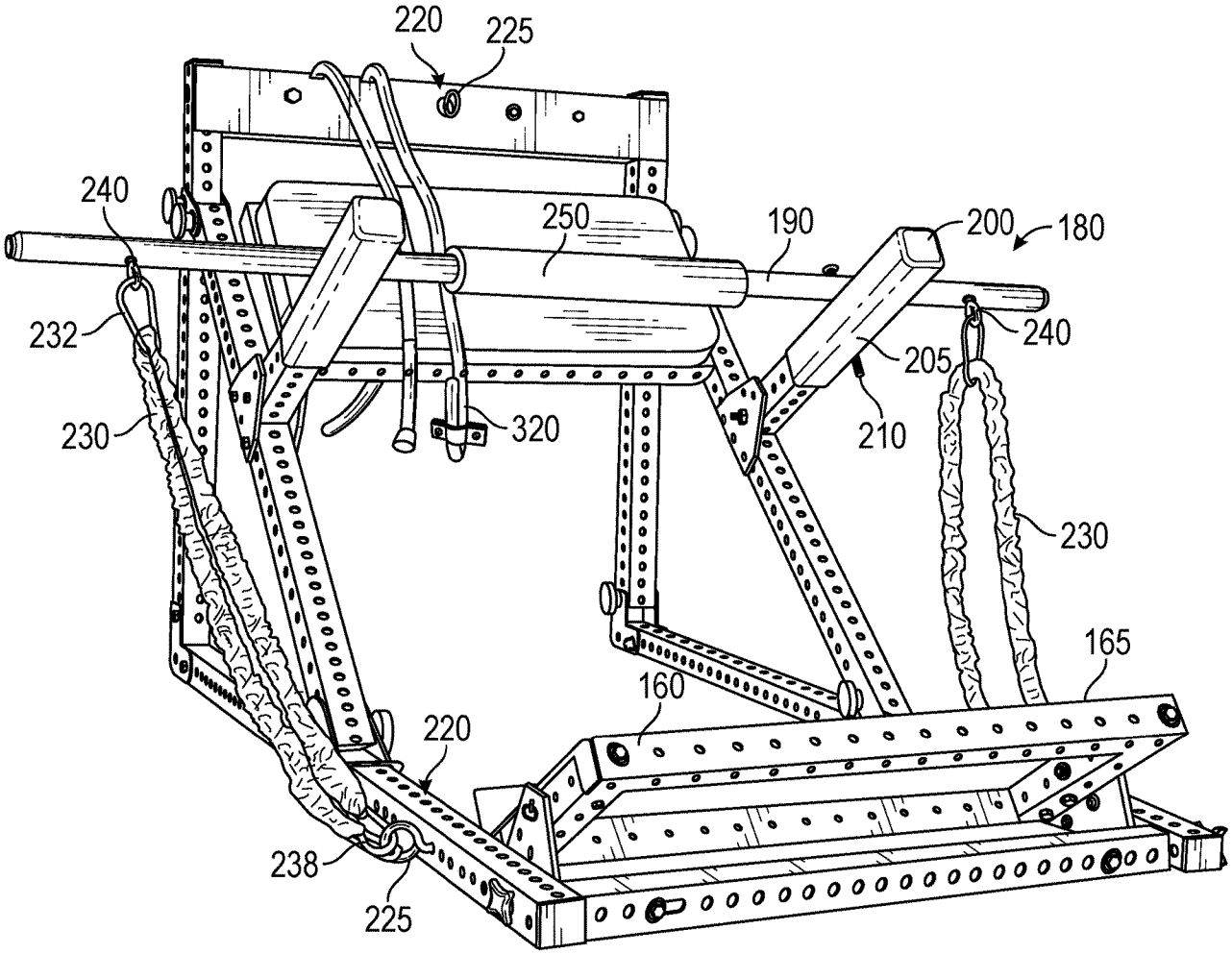
FIG. 2 is a front perspective view of the invention, illustrating the invention in its assembled configuration and ready for use, with a barbell and two resistance bands.
Figure 3:
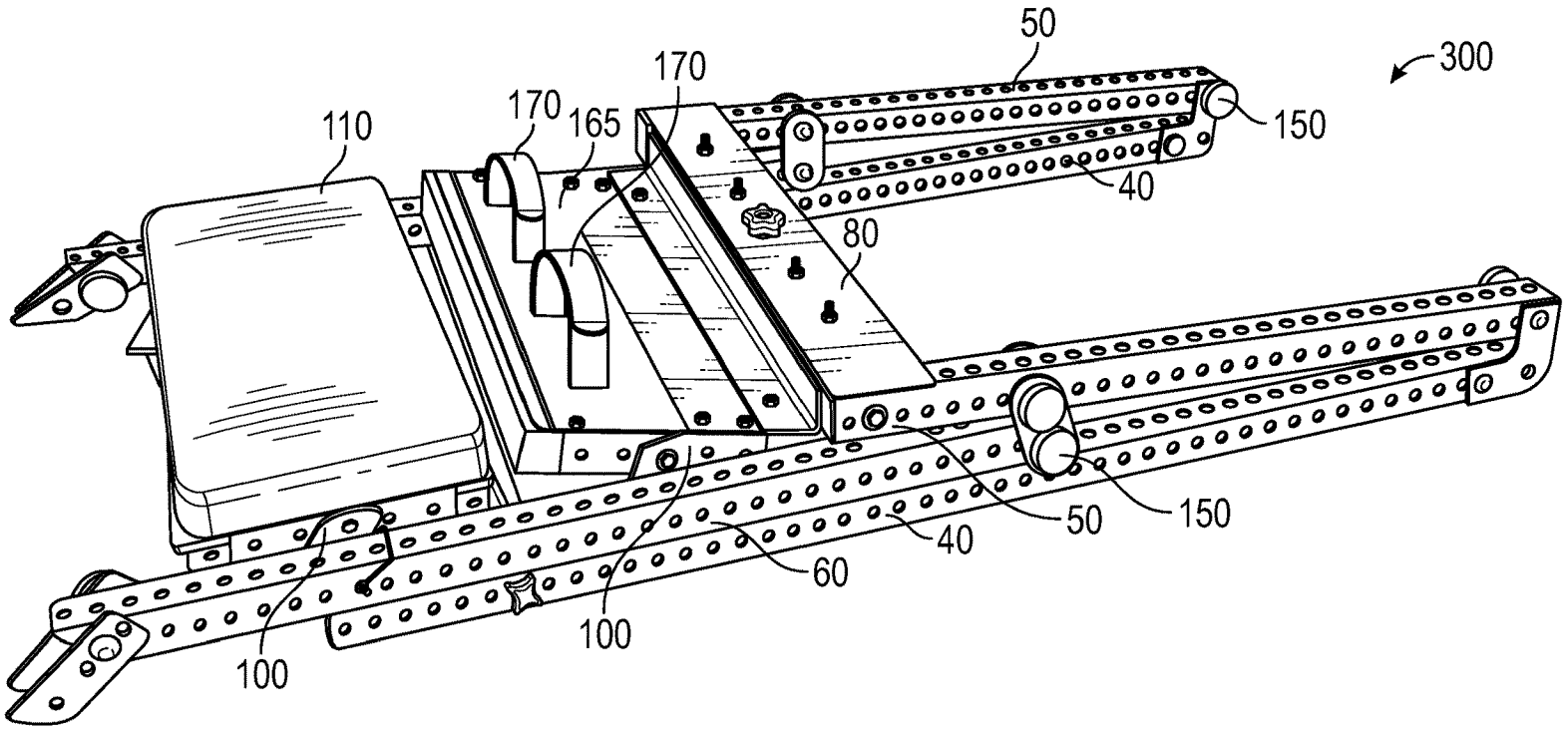
FIG. 3 is a side elevational view of the invention in the collapsed configuration.
Figure 4:
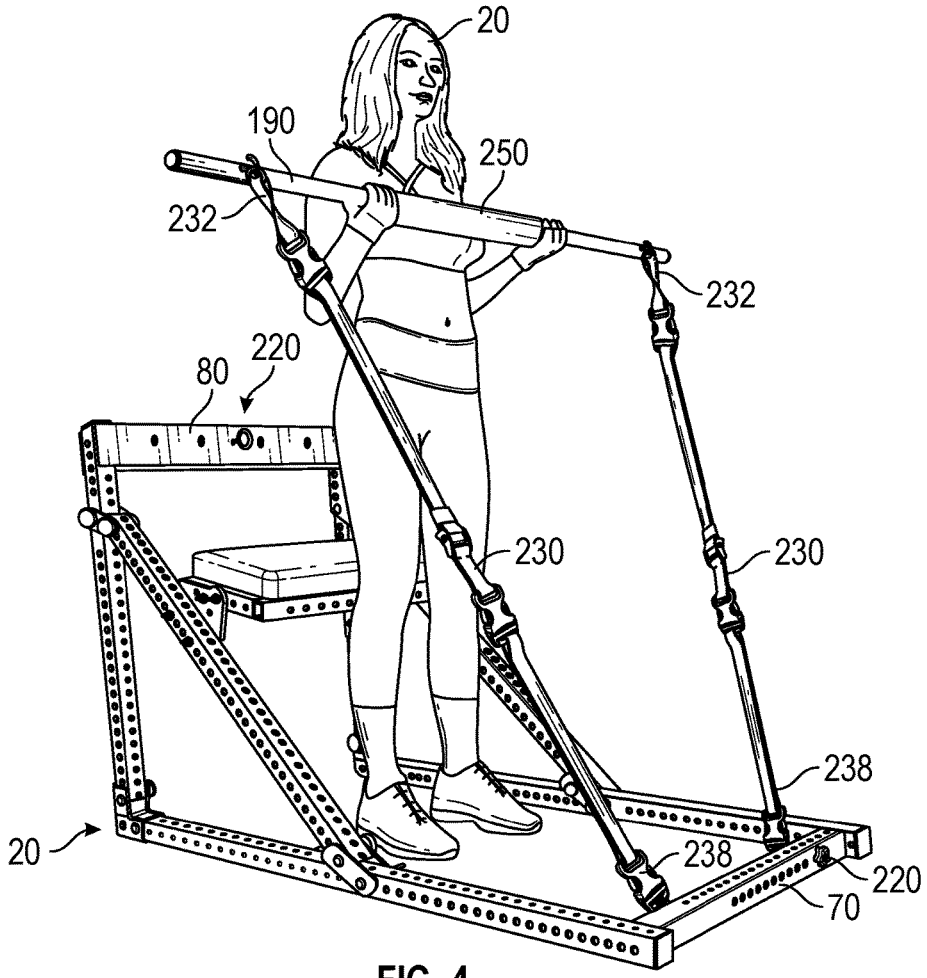
FIG. 4 is a side perspective view of the invention, shown in use by a person standing and engaged in an arm exercise with the barbell and resistance bands.
Figure 5:
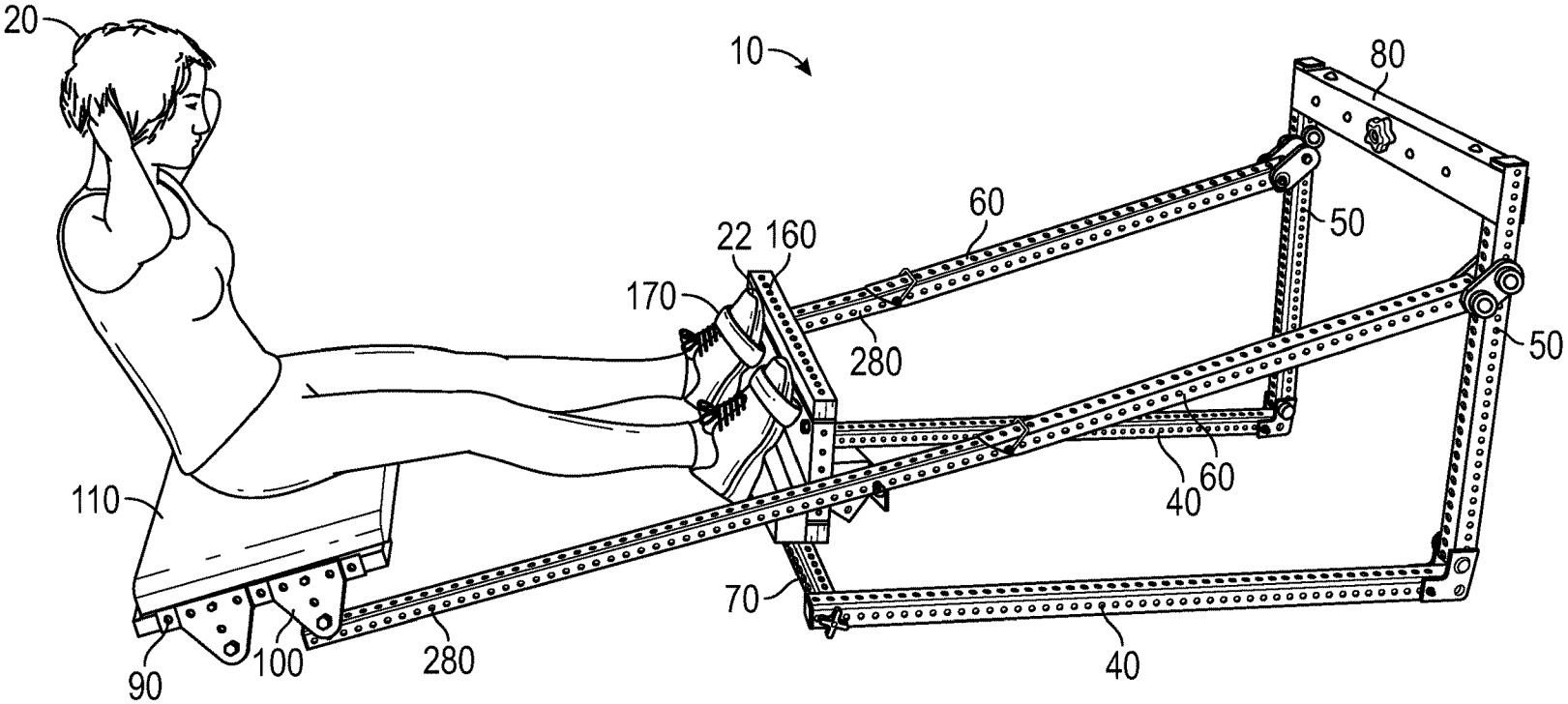
FIG. 5 is a side perspective view of the invention, shown in use by a person sitting with her feet secured in the foot straps and engaged in an abdominal exercise.
Figure 6:
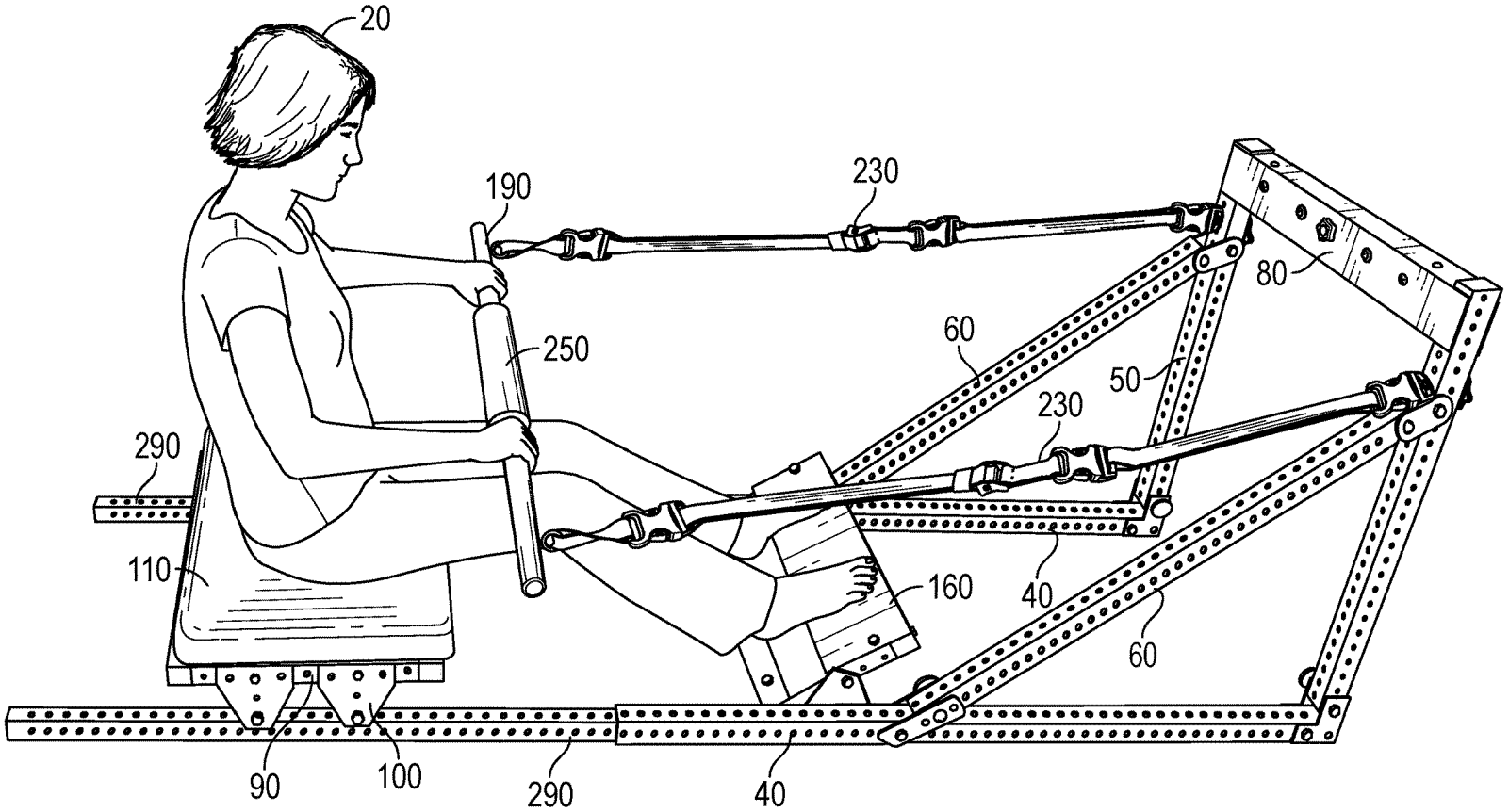
FIG. 6 is a side perspective view of the invention, shown in use by a person sitting with her feet braced against the footrest and engaged in an exercise using the barbell and resistance bands.

When not in use, the exercise bench 10 may be configured into a collapsed configuration 300 (FIG. 3), enabling the easy movement or storage of the exercise bench 10. When the exercise bench 10 is in the collapsed configuration 300, it may be secured in place using a rope 320 (FIG. 2). When the exercise bench 10 is in the assembled configuration 310, the rope 320 may be stored by wrapping it around the top cross member 80. The rope 320 may also be used together with the exercise bench 10 by the person 20 to perform specific types of exercises.

While a particular form of the invention has been illustrated and described, it will be apparent that various modifications can be made without departing from the spirit and scope of the invention. For example, multiple variations of the resilient cushion 110 may be used, including but not limited to those made from Plastazote® or another high-density foam, and those covered in leather, vinyl, or neoprene, and the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above Detailed Description of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above Detailed Description. While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. An exercise bench for a person to exercise on a support surface, the exercise bench comprising: a pair of side frames each including a base member, a rear member projecting upward from a rear side of the base member, and an angled member fixed at an angle between the base member and the rear member, the pair of side frames being aligned and mutually fixed together at a forward cross member and a top cross member; a seat fixed between the pair of side frames at the respective angled members and attached thereto, respectively, with a pair of pivot mechanisms, the seat including a resilient cushion fixed between the pair of pivot mechanisms; wherein each base member, rear member, and angled member of the pair of side frames, and the forward cross member each being formed with a perforated square metal tube material having a plurality of longitudinally-aligned equally-spaced apertures formed along each side thereof, and wherein each pivot mechanism includes a first aperture engagement mechanism, whereby a position of the seat may be adjusted along any of the base members, rear members, and angled members of the pair of side frames; and whereby with the base members resting on the support surface, the person can adjust an angle of the seat to support his weight while performing exercises.

2. The exercise bench of claim 1 wherein each pivot mechanism includes a second aperture engagement mechanism, whereby a position of each of the base members, rear members, and angled members of the pair of side frames may be adjusted along any of the other base members, rear members, and angled members of the pair of side frames.

3. The exercise bench of claim 1 further including a footrest fixed between the pair of side frames at the respective base members and attached thereto with a second pair of pivot mechanisms.

4. The exercise bench of claim 3 wherein the footrest includes a foot plate having two foot straps projecting outwardly therefrom, whereby the person can place his feet on the foot plate through the foot straps to hold his feet to the footrest while exercising.

5. The exercise bench of claim 1 further including a pair of barbell supports each fixed with one of the pivot mechanisms to one of the base members, rear members, or angled members of the pair of side frames, whereby a barbell is supported on the pair of barbell supports while the person exercises.

6. The exercise bench of claim 5 wherein each barbell support is formed with the perforated square metal tube material having the plurality of longitudinally-aligned equally-spaced apertures formed along each side thereof, a durable cover fitted over a distal end of each barbell support, a pair of apertures formed through each durable cover and aligned with two of the apertures of the metal tube material of each respective barbell support such that a barbell stop can be fixed therethrough to support the barbell and prevent the barbell from rolling.

7. The exercise bench of claim 1 further including at least one resistance band anchor fixable through any opposing apertures of the base members, the rear members, the angled members, and the forward cross member and including a rigid ring through which one of either a distal end or a proximal end of a resistance band may be fixed.

8. The exercise bench of claim 7 further including a barbell having two opposing resistance band attachment rings fixed therewith, such that the resistance band may be fixed at the proximal end thereof to the barbell and at the distal end thereof to the at least one resistance band anchor, whereby the person can lift the barbell to stretch the resistance band.

9. The exercise bench of claim 8 wherein a padded cushion is fixed around the barbell between the two opposing resistance band attachment rings.

10. The exercise bench of claim 7 further including the resistance band fixed at the proximal end thereof to a foot loop and at the distal end of the resistance band to the at least one resistance band anchor, whereby the person can engage the foot loop with his foot and stretch the resistance band.

11. The exercise bench of claim 1 further including a pair of angled member extensions each made with the perforated square metal tube material having the plurality of longitudinally-aligned equally-spaced apertures formed along each side thereof, each telescopingly attachable with one of the angled members.

12. The exercise bench of claim 1 further including a pair of base member extensions each made with the perforated square metal tube material having the plurality of longitudinally-aligned equally-spaced apertures formed along each side thereof, each telescopingly attachable with one of the base members.

13. The exercise bench of claim 1 further including at least one resistance band comprising: a resistance band anchor fixable through any opposing apertures of the base members, the rear members, the angled members, and the forward cross member; an elastic portion; a non-elastic portion; and a user interface portion; wherein the elastic portion and the user interface portion are each selectively interchangeable for changing an elastic resistance of the at least one resistance band and for allowing engagement of the at least one resistance band with a different part of the person's body.

14. The exercise bench of claim 13 wherein the resistance band anchor and the non-elastic portion are engageable with the elastic portion at a pair of buckle mechanisms, and wherein the user interface portion is engageable with the non-elastic portion at a third buckle mechanism.

* * * * *